US006755105B2

(12) United States Patent
Downing

(10) Patent No.: US 6,755,105 B2
(45) Date of Patent: Jun. 29, 2004

(54) METHOD AND APPARATUS FOR CUTTING ELASTOMERIC MATERIALS AND THE ARTICLE MADE BY THE METHOD

(75) Inventor: Daniel Ray Downing, Uniontown, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 237 days.

(21) Appl. No.: 09/871,766

(22) Filed: Jun. 1, 2001

(65) Prior Publication Data

US 2002/0178880 A1 Dec. 5, 2002

(51) Int. Cl.[7] ..... B26D 1/04; B26D 3/02; B26D 7/02

(52) U.S. Cl. ..... 83/175; 83/100; 83/282; 83/453; 83/581; 83/614; 83/956

(58) Field of Search ..... 83/175, 176, 100, 83/282, 453, 581, 614, 701, 956

(56) References Cited

U.S. PATENT DOCUMENTS

| | | | | |
|---|---|---|---|---|
| 4,560,427 A | | 12/1985 | Flood | 156/73.3 |
| 4,610,750 A | | 9/1986 | Mango | 156/510 |
| 4,920,495 A | * | 4/1990 | Pilkington | 83/956 X |
| 4,922,774 A | | 5/1990 | Oldeman | 83/175 |
| 4,987,808 A | * | 1/1991 | Sicka et al. | 83/175 X |
| 5,265,508 A | | 11/1993 | Bell et al. | 83/136 |
| 5,273,601 A | | 12/1993 | Sergel et al. | 156/133 |
| 5,350,470 A | * | 9/1994 | Mochel et al. | 156/136 |
| 5,480,508 A | * | 1/1996 | Manabe et al. | 156/353 |
| 5,638,732 A | * | 6/1997 | Becker et al. | 83/461 |
| 5,746,101 A | * | 5/1998 | Benzing, II et al. | 83/34 |

FOREIGN PATENT DOCUMENTS

| | | | |
|---|---|---|---|
| DE | 2805870 | 8/1979 | B29H/17/30 |
| WO | WO 00/23261 | 4/2000 | B29D/30/46 |

* cited by examiner

*Primary Examiner*—Charles Goodman
(74) *Attorney, Agent, or Firm*—David L. King; June E. Rickey

(57) ABSTRACT

A method of an apparatus for cutting segments (10) to desired lengths from a strip (1) of elastomeric tire components having at least one cord reinforced component involves the step of impacting one cord (22) as the cut is being made and lifting the cord (22) to avoid cutting cords (22) while directing the cutting path along the lifted cord (22). The article resulting from the method has a plurality of cords (22) adjacent a flat cut splicing surface (8) suitable for lap splicing.

10 Claims, 9 Drawing Sheets

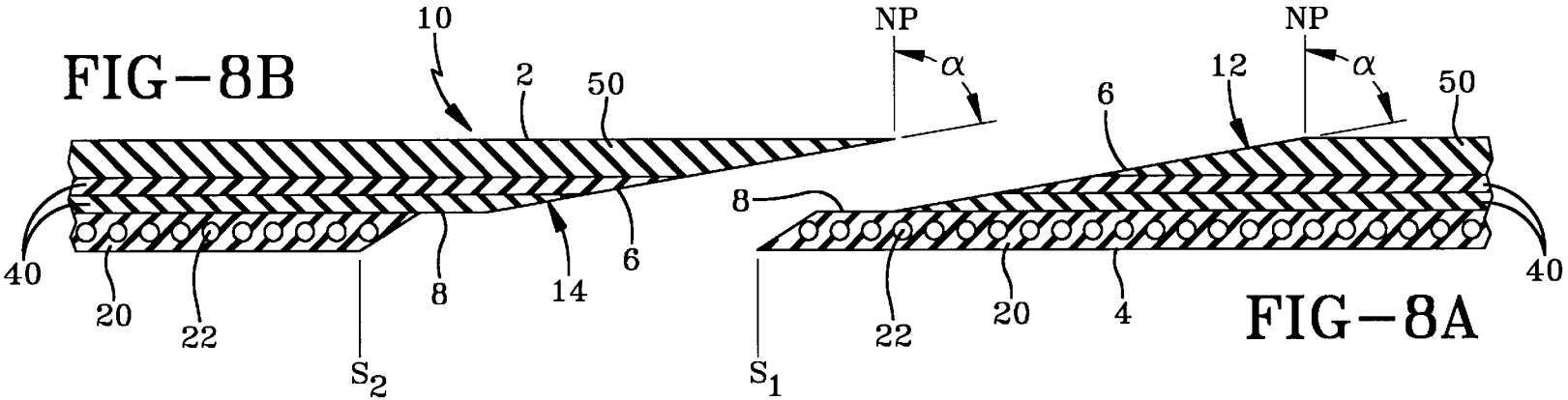
FIG-8A
FIG-8B
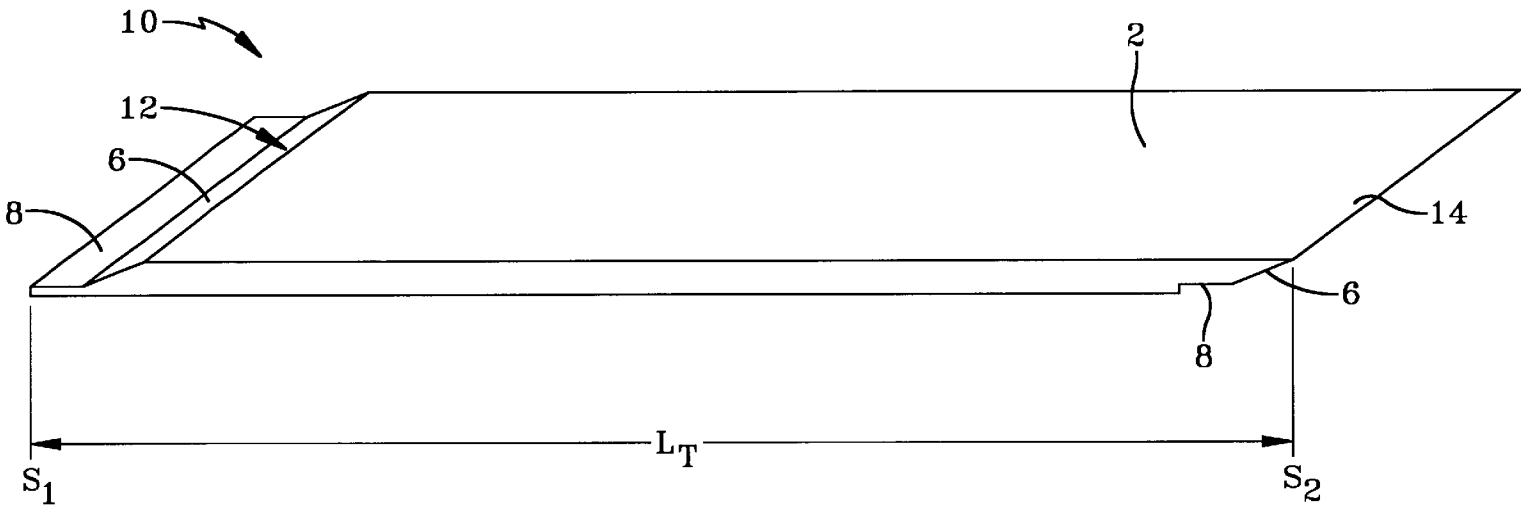
FIG-8C

METHOD AND APPARATUS FOR CUTTING ELASTOMERIC MATERIALS AND THE ARTICLE MADE BY THE METHOD

TECHNICAL FIELD

This invention relates to methods and apparatus for cutting elastomeric materials at low skive angles, in particular cutting layered composites of elastomeric materials including layers containing reinforcing materials.

BACKGROUND OF THE INVENTION

Various methods and apparatus have been used for the cutting of sheets of elastomeric material. Such elastomeric material might consist of single sheets of the homogeneous material, or multiple layered sheets of materials having properties that are different from one another. In the case of multiple layered sheets of elastomeric material that, for various reasons, need to be cut, one or more of the layers might contain reinforcing cords or fibers made of metal or fabric. Such reinforcing cords or fibers might be simply aligned in such a way as to be parallel to one another. Furthermore, the elastomeric materials that are to be cut may or may not be cured or vulcanized at the time of cutting.

Prior art cutting methods and apparatus include cutting wheels, ultrasonic cutters, guillotine knives, wire cutters and vibrating scroll cutters whose active cutting principle is a saw blade or a blade or a tensioned wire.

While such prior art cutting methods are effective to varying degrees, each has disadvantages. For example, the guillotine knife is somewhat effective in cutting composite elastomeric materials, but it has the disadvantage of having a tendency to deform the cut surfaces of the elastomeric material as the knife penetrates the material. Such deformation of the cut edge increases the difficulty of subsequent splicing the ends of the elastomeric material. Moreover, the guillotine knife produces a continually degraded cut surface as the blade becomes dull and as small pieces of elastomer began to build up on the blade. Yet another disadvantage was the inability of the blade to cut at an angle less than 30 degrees relative to the plane of the material being cut. The guillotine blade also tends to generate heat during the cutting process such that, as numerous cuts are made, the temperature of the knife becomes sufficiently elevated in some cases to induce precuring of unvulcanized elastomer in the region of the cut, which then inhibits subsequent proper splicing along the cut edges.

Another prior art cutting system and method, disclosed in U.S. Pat. No. 5,638,732, employs a cutting wire. This system could not, however, be used to cut preassembled elastomeric composite sheets containing reinforcing cords because the reinforcing cords themselves, though aligned more or less parallel to the direction of the cut, get severed. This deficiency is actually inherent to nearly every prior art cutting technology including ultrasonic knives, that cut composite elastomeric preassemblies at relatively low skive angles. That is to say, nearly all prior art cutting methods tended to cut the parallel-aligned cords that are used to reinforce one or more layers of reinforced ply. The cut is ideally intended to be made between the parallel-aligned reinforcing cords. One prior art exception is the scroll cutter, which can cut at low skive angles without also risking cutting the reinforcing cords.

The scroll cutter cannot, however, initiate its cut at a low skive angle through a cord reinforced sheet of preassembled composite elastomeric sheets, because of its geometry, which includes a wire held at each end by a fixture. The scroll cutter must start its cut from the side of the preassembly, such that the cutting has difficulty entering the ply without splitting the reinforcing cords. Even at a 90-degree skive angle, the reliability of not splitting cords is in question. At low skive angles it becomes exponentially difficult to enter the ply without splitting a ply cord. Sometimes the reinforced ply end will be buried under the other layers, such as, in the case of tire manufacturing, the sidewall layer or other layers such as the extreme edge of the preassembly within the context of envelope construction. This adds another dimension of difficulty for the wire scroll cutter to cut reliably a preassembly with reinforced layers, such as specifically, the ply of tires.

Ultrasonic cutting systems as disclosed in U.S. Pat. No. 5,265,508, can cut stock material at low skive angles. However, they require that the material be secured to an anvil during cutting. Another system, disclosed in U.S. Pat. No. 4,922,774, employs an ultrasonic cutting device, which vibrates a knife that moves across an elastomeric strip. However, this system is limited to cutting angles of between 10 and 90 degrees, and it does not provide for cutting between parallel disposed, reinforcement cords within the strip, which is to say, the cords can get cut.

Various method have been attempted to cut through cord-reinforced composites employing ultrasonic knives. In PCT publication No. WO 00/23261, a pair of ultra sonic blades are employed wherein after the article to be cut is pierced in a central region the two blades cut in opposite directions toward each lateral edge of the composite.

In PCT publication No WD 00151810 an ultrasonic skive cuts above the cord reinforced member as a cutting knife follows making a second cut through the ply and between parallel cords thus forming an abutment surface for subsequent tire splicing of the cut to length segment. Each of these concepts requires multiple cutting mechanisms and are arguable complex to build and maintain the equipment.

A significant problem with the prior art cutting systems and methods is the inability to cut at angles less than 30 degrees relative to the plane of the elastomeric layers being cut without deformation or precuring the material. This can be a problem in, for example, automated tire building operations wherein the cutting has to be done precisely and quickly and where the cutter can also provide improvements to the cut surface which is subsequently to be spliced.

An ideal cutting method and apparatus should be able to make cuts at low angles relative to the plane of the elastomeric sheet being cut, and it should be able to do so without cutting the parallel-aligned reinforcing cords between which the cutter is ideally to move. It should also be able to make these low angle cuts rapidly and reliably.

SUMMARY OF THE INVENTION

A method of cutting segments to desired lengths from the strip of elastomeric material as disclosed. The segments have a width W, elastomeric strips being formed of a plurality of tire components, at least one of the tire components being a cord reinforced component. The cords of the reinforced tire component are substantially parallel oriented in the direction of a cutting path formed across the width W.

The method has the step of moving an ultrasonic knife into cutting engagement of the elastomeric strip while supporting the strip along the cutting path. Cutting the segment at a skive angle $\alpha$. Impacting a cord of the cord reinforced component while cutting thereby lifting said cord over the ultrasonic knife as the segment is being cut. The impacted cord is at a cut end adjacent to the cutting path. The method further has the step of orienting a cutting edge on the ultrasonic knife inclined at an acute angle θ relative to the strip-cutting path. In one embodiment of the invention, the method further has the step of movably restraining the strip ahead of the cutting.

The step of supporting the strip may further include supporting the strip at an angle θ1 less than the skive angle α on one side of the cutting path and at an angle θ2 greater than the skive angle on the opposite side of the cutting path. This causes the location of the impacted cord to occur approximately at the location wherein the supporting angle changes from θ1 to θ2.

In another embodiment the step of positioning the cutting edge of the ultrasonic knife includes the step of setting a gap distance (d) above the support approximately slightly less than or equal to the thickness of the cord reinforced component, along the region wherein the support is oriented at the angle θ2. The method further includes forming one cut end of the segment wherein a plurality of cords is beneath and adjacent to a flat cut surface.

A segment formed by the method described above results in a first cut end having a cut splicing surface extending outward from the cord reinforced component and a second cut end having a plurality of cords beneath and adjacent to a flat cut surface. The segment, when the first cut end and the second cut end are joined, forms a lap splice having one or more overlapping cords.

An apparatus for cutting segments from a strip of multi-layered elastomeric material containing reinforcing cords, the cords being substantially parallel and more or less oriented in the direction of the cut path, is described by the following features. A cutting element for cutting the strip to form cut ends has a cutting edge oriented to cut along a line 3, the line 3 being tangent to one or more cords and inclined at a desired skive angle α, and a means for supporting the strip along the cutting path, the means for supporting the strip having a first surface oriented at an angle θ1 less than the skive angle α, and a second surface oriented at an angle θ2 greater than or equal to the skive angle α, and a means for restraining the strip against the means for supporting, the means for restraining the strip preferably lying ahead of the cutting element, and being moveable. The apparatus further has a means for moving both the cutting element and the means for restraining during the cutting of the strip. In one embodiment, the apparatus has the cutting element having a cutting edge inclined at an acute angle β relative to the width of the strip. The cutting edge when oriented as described initiates cutting on the surface furthest away from the means for supporting the strip. The skive angle α is normally set about 10° or less forming a cut path adjacent to one or more cords of the strip being cut. While the means or supporting the strip has two surfaces inclined at angles $\theta_n$, and θ2 respectively, θ1 is preferably set about 2° less than the skive angle α, the angle θ2 is about 2° more than the skive angle α. In one embodiment the skive angle α is set to about 8°.

In a preferred embodiment the cutting element is an ultrasonic knife. The cutting element has a planer surface adjacent to the supporting means. The cutting element has a wedge shape increasing in thickness away from the cutting edge.

In a preferred embodiment the means for supporting the strip includes the vacuum-means for adhering the strip to the means for supporting during the cutting procedure.

Definitions

"Aspect Ratio" means the ratio of a tire's section height to its section width.

"Axial" and "axially" means the lines or directions that are parallel to the axis of rotation of the tire.

"Bead" or "Bead Core" means generally that part of the tire comprising an annular tensile member, the radially inner beads are associated with holding the tire to the rim being wrapped by ply cords and shaped, with or without other reinforcement elements such as flippers, chippers, apexes or fillers, toe guards and chafers.

"Belt Structure" or "Reinforcing Belts" means at least two annular layers or plies of parallel cords, woven or unwoven, underlying the tread, unanchored to the bead, and having both left and right cord angles in the range from 17° to 27° with respect to the equatorial plane of the tire.

"Bias Ply Tire" means that the reinforcing cords in the carcass ply extend diagonally across the tire from bead-to-bead at about 25–65° angle with respect to the equatorial plane of the tire, the ply cords running at opposite angles in alternate layers "Breakers" or "Tire Breakers" means the same as belt or belt structure or reinforcement belts.

"Carcass" means a laminate of tire ply material and other tire components cut to length suitable for splicing, or already spliced, into a cylindrical or toroidal shape. Additional components may be added to the carcass prior to its being vulcanized to create the molded tire.

"Circumferential" means lines or directions extending along the perimeter of the surface of the annular tread perpendicular to the axial direction; it can also refer to the direction of the sets of adjacent circular curves whose radii define the axial curvature of the tread as viewed in cross section.

"Cord" means one of the reinforcement strands, including fibers, which are used to reinforce the plies.

"Inner Liner" means the layer or layers of elastomer or other material that form the inside surface of a tubeless tire and that contain the inflating fluid within the tire.

"Inserts" means the crescent—or wedge-shaped reinforcement typically used to reinforce the sidewalls of runflat-type tires; it also refers to the elastomeric non-crescent shaped insert that underlies the tread.

"Ply" means a cord-reinforced layer of elastomer-coated, radially deployed or otherwise parallel cords.

"Radial" and "radially" mean directions radially toward or away from the axis of rotation of the tire.

"Radial Ply Structure" means the one or more carcass plies or which at least one ply has reinforcing cords oriented at an angle of between 65° and 90° with respect to the equatorial plane of the tire.

"Radial Ply Tire" means a belted or circumferentially-restricted pneumatic tire in which the ply cords which extend from bead to bead are laid at cord angles between 65° and 90° with respect to the equatorial plane of the tire.

"Sidewall" means a portion of a tire between the tread and the bead.

"Skive" or "skive angle" refers to the cutting angle of a knife with respect to the material being cut; the skive angle is measured with respect to the plane of the flat material being cut.

BRIEF DESCRIPTION OF THE DRAWING

The structure, operation, and advantage of the invention will become further apparent upon consideration of the following description taken in conjunction with the accompanying drawings wherein:

FIG. 8A is an edge view of the segment first end.

FIG. 8B the second end.

FIG. 8C the cut-to-length segment.

DETAILED DESCRIPTION OF THE INVENTION

Figure 1:
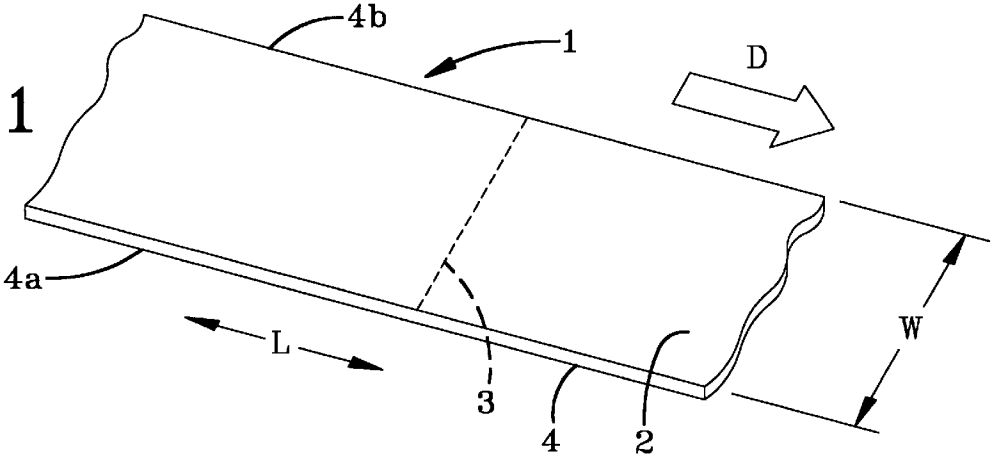
FIG. 1 is a schematic view of a multi-component strip (1) of elastomeric material, showing a path (3) where the ends of a segment are to be formed.

With reference to FIG. 1, a strip of elastomeric material is illustrated in oblique view. The strip (1) has a transverse width W and an indefinite length designated by the L direction. The strip (1) is transported upon a conveyor means (not shown) in the direction D. The strip (1) comprises one or more elastomeric components. The dotted line (3) shows the location or path of a lateral cut that is to be made across the width of the strip (1) of elastomeric material from edge 4*a* to edge 4*b*.

The path (3) that extends across the width W of the strip (1) can be perpendicular to the length L of the strip or obliquely traversing across the width W. If the strip (1) has one or more layers of the parallel cords (22) that are similarly oriented, then it is preferred that the path (3) is similarly oriented relative to the cord (22) path.

Figure 2:
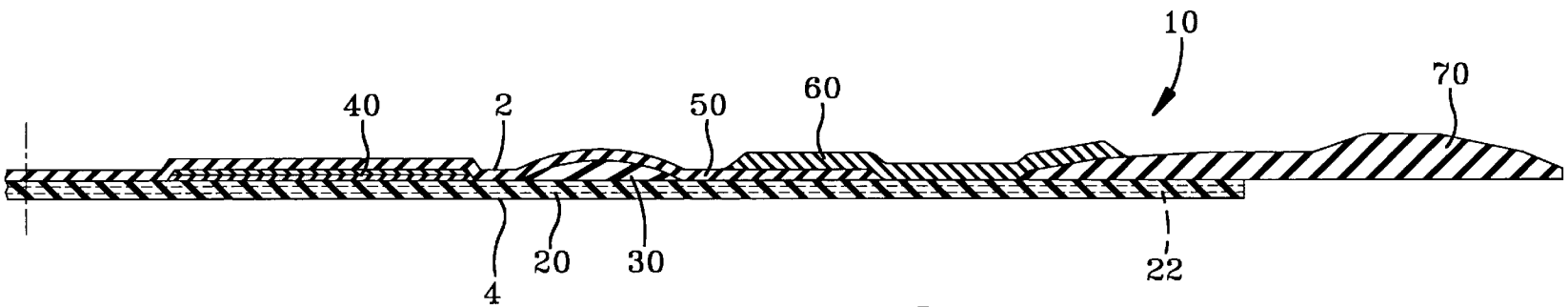
FIGS. 2 and 3 are detailed views of one type of multi-component strip of elastomeric material shown in FIG. 1.
Figure 3:
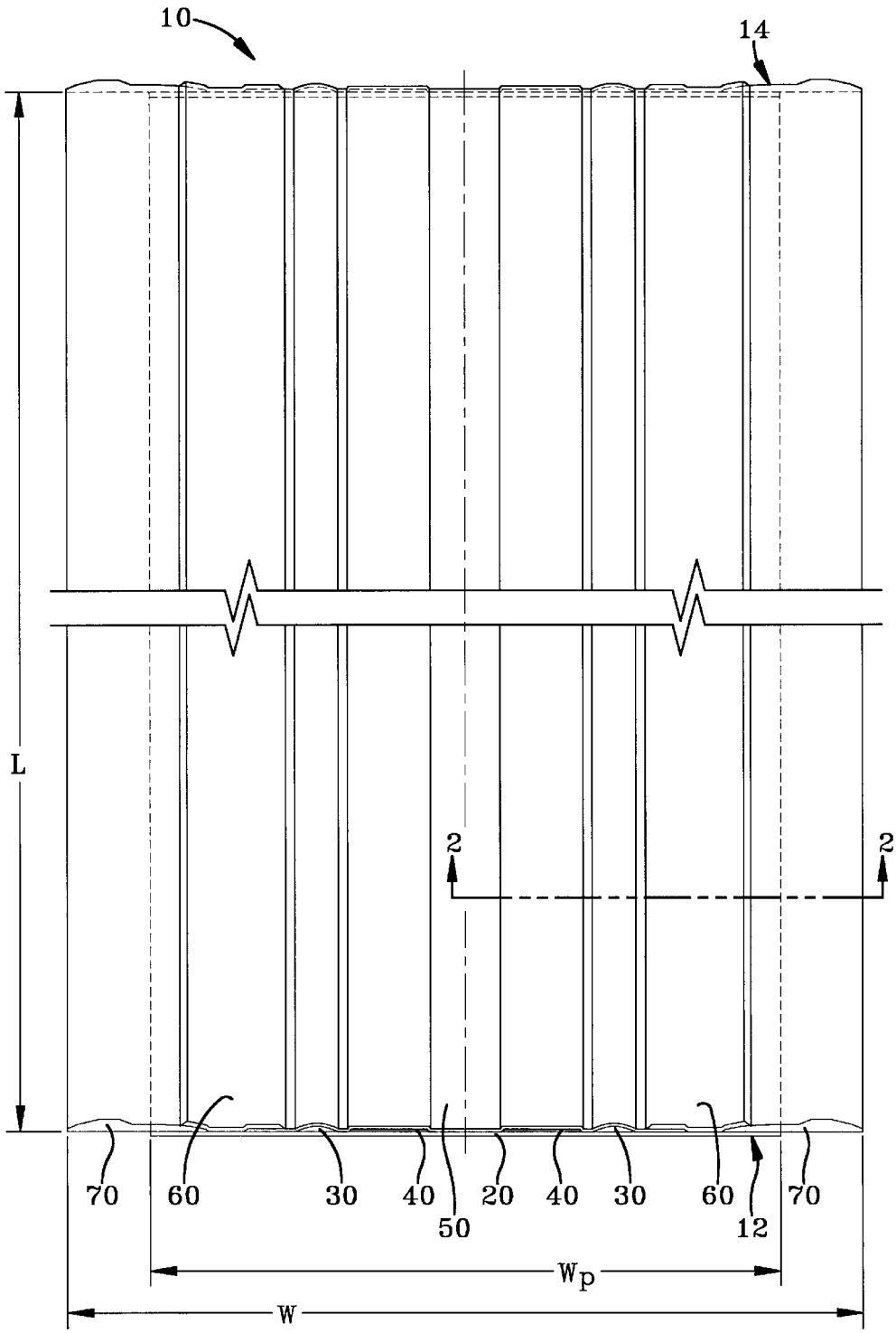
Figure 4A:
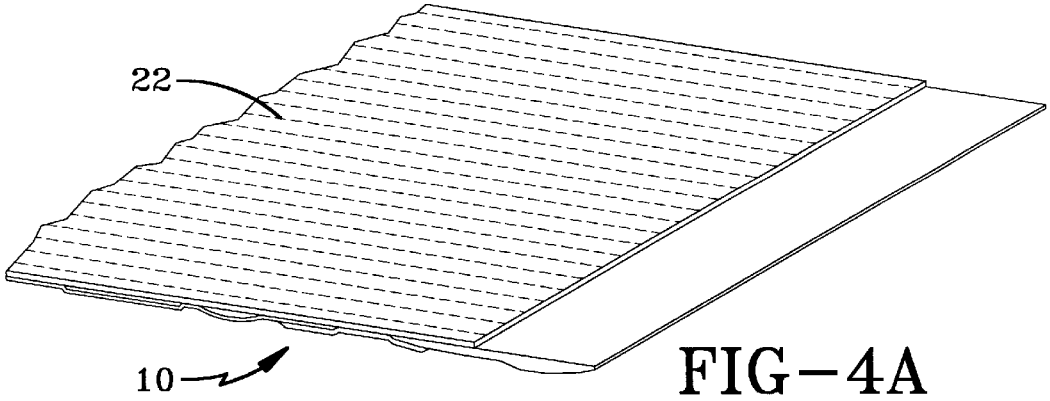
FIG. 4A is a detailed view of a multi-component cord reinforced elastomeric strip wherein the cords are in a parallel layer oriented at a bias angle relative to the length of the strip.
Figure 4B:
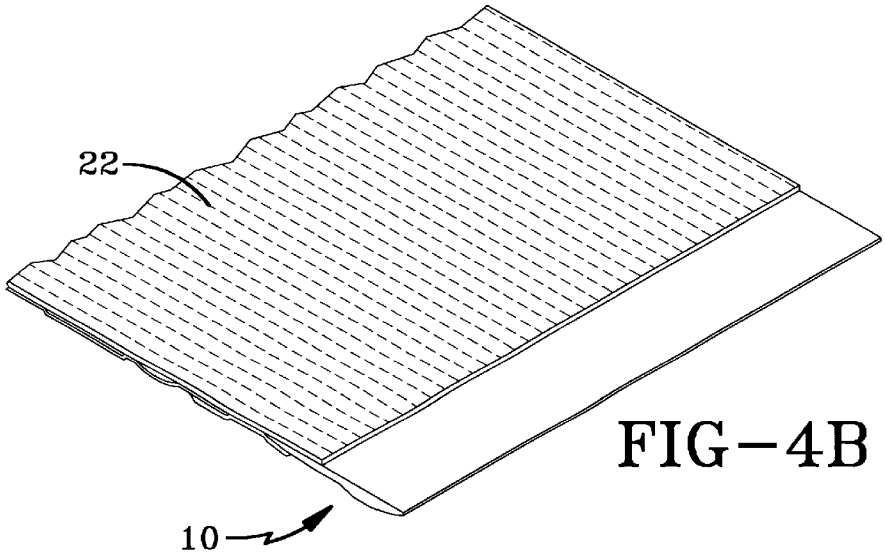
FIG. 4B is a detailed view of a multi-component cord reinforced elastomeric strip wherein the cords are in a parallel layer oriented at an angle normal to the length of the strip.

In the various figures shown, the elastomeric strips (1) are various components used in the manufacture of tires. FIGS. 2 and 3, for example, is a detailed view of a multi-component strip (1) of elastomeric material, the strip (1) as shown has ply (20) having a width Wp less than the strip width W, inserts (30), shoulder gum strips (40), a liner (50), a pair of chaffer strips (60), and a pair of sidewall components (70). In FIGS. 4A and 4B, multi-component strips are shown. In FIG. 4A, the combination of tire components of FIG. 2 are combined with a bias ply (20) reinforced by cords (22) that are parallel and similarly oriented at an oblique angle relative to the length of the ply (20), generally in an angular orientation of 30° to 65°. In FIG. 4B, the combination tire components of FIGS. 2 and 3 is combined with a ply (20) having parallel and similarly oriented cords (22) that are inclined at an angle in the range of 65° to 90° relative to the length of the strip (1). In FIGS. 4A and 4B, the cords of the multi-component strip (1) are substantially shorter in length than the path (3) across the strip. In such a case, the ends of the cords (22) are not exposed making it very difficult to form a splice end without cutting or damaging a cord (22). While the inventive method of the present invention is not limited to the creation of splice surfaces for tire components and is readily applicable to any elastomeric strip having tacky surface adhesion properties, for the purpose of discussing the inventive method apparatus, tire components as described above will be used to exemplify the inventive principles of the claimed method and apparatus.

In practicing the invention, it is understood that the forming of the ends (12, 14) of a segment (10) taken from a strip (1) of elastomeric material is accomplished in a similar way regardless of the component types. This is true if the strip (1) is reinforced with parallel cords (22) perpendicular to the strip length or reinforced with bias angled cords (22).

Figure 5A:
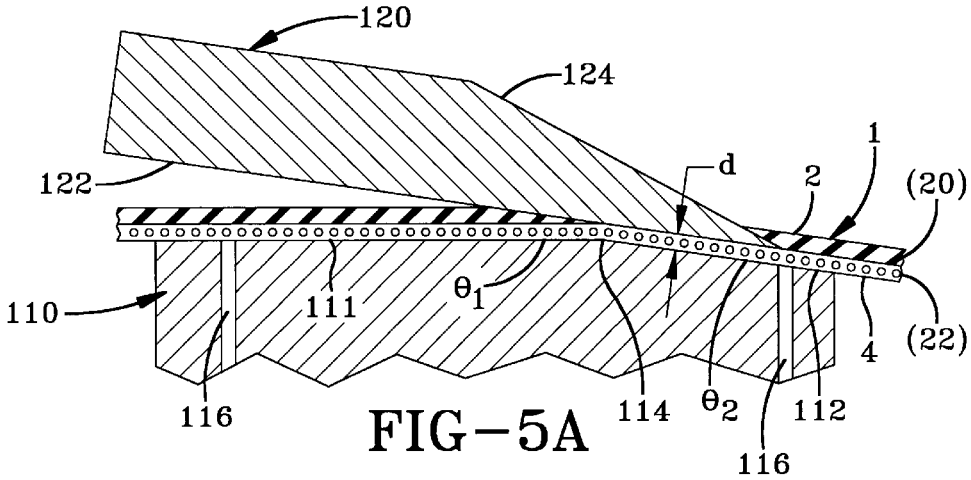
FIG. 5A is an edge view of an elastomeric strip showing the forming of the low skive angle surface.
Figure 5B:
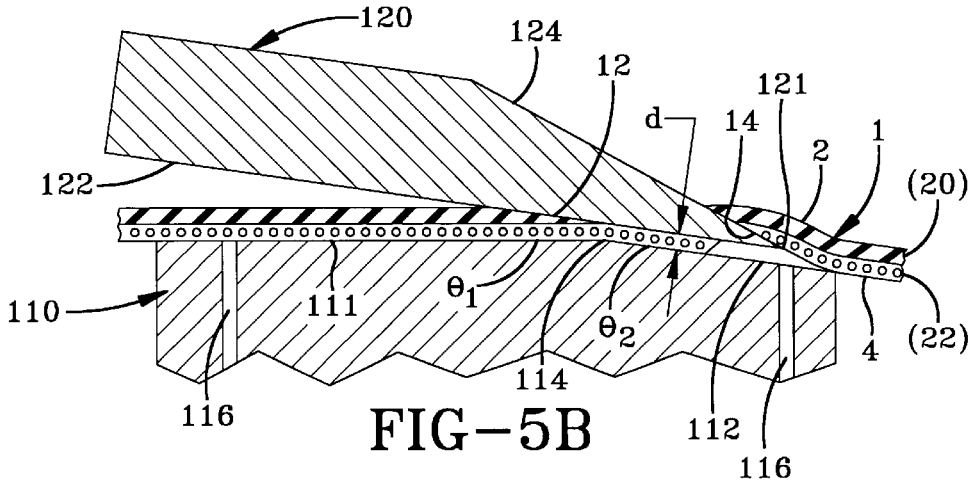
FIG. 5B is an edge view of the preferred method of after impacting a cord and then forming the rest of the low angle skive surface on an elastomeric strip.
Figure 5C:
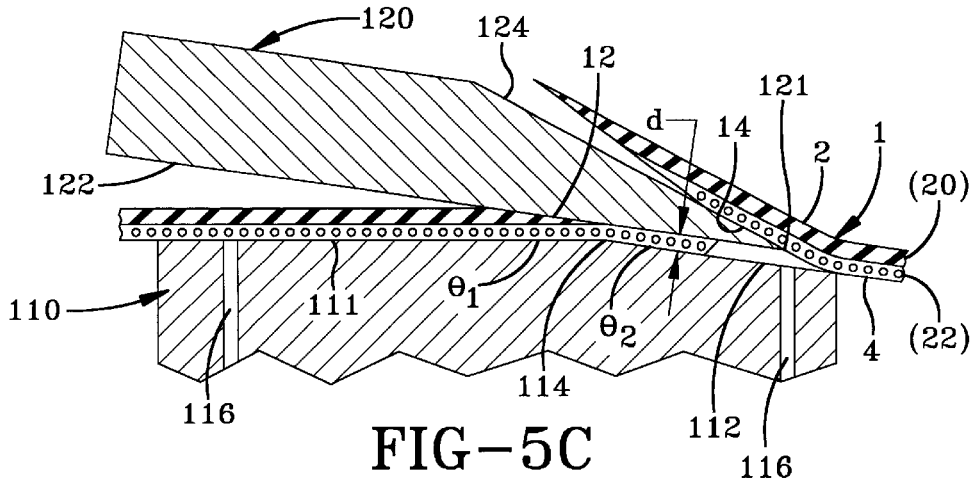
FIG. 5C is another edge view of the preferred method of forming the ends (12, 14) on the elastomeric strip of FIG. 5B showing the strip separating at the cut ends.

In practicing the invention, as shown in FIGS. 5A through 5C, a strip (1) of elastomeric material is shown on an edge view. As shown in FIG. 5A, the preferred method has the strip (1) supported on a second side (4) and a cutting element (120) cutting edge (124) passes through the strip (1) along a path that transverses across the entire width of the strip (1). The cutting element (120) is positioned to cut at a very low skive angle $\alpha$ of less than 30° relative to the first side (2) of the strip (1), preferably the skive angle $\alpha$ is approximately 10° or less.

As shown, the cutting element (120) is an ultrasonic blade. The ultrasonic blade initiates cutting to one side of the elastomeric strip (1) while the strip is supported on a supporting means (110). The supporting means (110) is preferably an anvil that has an outer surface adjacent to the cord reinforced tire component. This outer surface preferably has a first surface (111) inclined at an angle of $\theta 1$, $\theta 1$ being less than the skive angle $\alpha$. A second surface (112) is provided wherein the second surface (112) is inclined at an angle $\theta 2$, $\theta 2$ being at an angle equal to or greater than the skive angle $\alpha$. As illustrated, the cord reinforced tire component (20) is adjacent to the surfaces (111, 112). As can be seen, the ultrasonic blade (120) is positioned at a slight distance (d) spaced above the anvil (110). That distance creates a gap (d) of approximately 0.0030 inch. This gap (d) is sufficient to allow the cord reinforced tire component (20) to pass under the ultrasonic blade (120) during the cutting procedure.

With reference to FIG. 5B, as the ultrasonic blades (120) transverses through the strip (1) being cut, the blade (120) will make initial contact with non cord reinforced components prior to meeting with the cord-reinforced component (20). The blade (120) will impact a cord (22), which results in the cord (22) being lifted off of the anvil (110) slightly and thus rides over the blade (120) over the cutting edge (124). On the opposite side of the cut, the cords (22) are pressed under the ultrasonic blade (120) and occupy the gap (d) that was provided between the anvil (110) and the blade (120) for this cutting procedure. As illustrated, three or more cords (22) are shown adjacent to the flat surface (122) of the cutting blade (120). The ability of the cords (22) to be lifted over the blade (120) permits the ultrasonic knife blade (120) to pass through the cords (22) without cutting any of the cords (22). This is true because of the separation of the cut ends (12, 14) is created by the sharp cutting edge (121) of the blade (120). By combining the rate of speed at which the blade (120) is moving and the fact that the cords (22) are a more resistant material than the elastomeric rubber, it is possible to easily cut through the rubber without damaging the cords (22). As illustrated in FIG. 5C, once the blade (120) is interposed between two adjacent cords (22) the cut surface (6) riding over the blade (120) is allowed to ride freely upward and is lifted slightly. This prevents the cut surface (6) of end 14 from reattaching itself to the other cut end (12) of the elastomeric strip (1).

As shown in the invention, all the cutting is shown with the components lying in a horizontal direction and being cut from the top. It should be noted that in normal cutting and for simplicity of tire building it is sometimes desirable, even preferable to invert these strips such that the entire figure could be inverted relative to the ground and that the cutting is actually occurring from below the surface upward. For purposes of this invention, however, it is sufficient to note that these materials can be cut from either direction as shown or in an inverted position cutting from the underside.

As illustrated in the FIG. 5C, the ultrasonic blade (120) itself provides a key feature in enabling the strip to be cut in such a fashion that one end (14) of the cut segment (10) lifts and rides over the blade (120) as the blade (120) traverses through the strip while the other cut end (12) is actually held down by the blade (120) as the blade is making the cut. As illustrated, one cord (22) is generally snagged or raised off the anvil (110) slightly as the cutting blade (120) enters the ply edge. This snagged cord (22) often times can be slightly bent even pulled out from the cut ends (12, 14). It has been determined in tire building that this cord (22) is of no consequence to the tire's structural integrity in that when the cord is snagged or bent, that portion of the impacted cord (22) will lie on the turn-up side of a bead and is not part of a structural component of the tire or the working component of the tensioned ply because the bend portion of the impacted cord lies at the radially outer portion of the ply turn up. It is important, however, that the cord (22) that is snagged does not prevent good uniform splicing. It has been found by having the cutting edge (121) of the cutting element (120) inclined at an acute angle of approximately 60° or less relative to the width of the ply, the cutting initials from the top surface to the anvil supported surface and can be accomplished with minimal damage to the one impacted cord (22).

It has been found that by transitioning the support (110) from an angle θ1 at one surface (111) to θ2 at the other surface (112) and fixing the gap (d) at the transition location (114), one can predict where the cord (22) impact with the blade edge 121 will occur rather repeatedly. This is important in establishing a precise length of the cut segment (10). As shown in the cross sectional view of the segment (10), the cutting blade (120) has a flat surface (122) and the lower portion or second side (4) of the strip (1) adjacent to the support (111) at surface (112) is inclined at an angle θ2 is approximately equal to the lower inclination of the surface (122) of the cutting blade (120) ensures that the elastomeric strip (1) is cut in such a fashion that a flat surface (8) occurs directly above two or more preferably three or more of the ply cords (22). This effectively filets the elastomeric material directly above the ply cords, exposing these ply cords (22) to a flat cut surface (8). This flat cut surface (8) greatly facilitates the ability to create an overlapping splice joint (15) in tire building. This overlapping splice joint heretofore was hindered by the elastomeric components being directly above the lapped ply cords (22). By removing this material, in this unique cutting fashion it is possible to create an overlap cord splice (15) that is stronger than other splices used in radial tire building. It is well known that when the cord splices (15) are overlapped, one can insure a stronger lap spliced joint. Heretofore, these lap splice joints were avoided due to the fact that the multi-layered components would create too much mass imbalance at the lap splice (15) due in part to the amount of material directly above the cord (22). In attempts to reduce this problem, the skive angle α was reduced to a very low angle of 10° or less. Nevertheless, this resulted in still too much material at the lap splice joint creating a slight mass imbalance. Therefore, it had been recommended in the past to create butt splices such that the cords (22) to not overlap. While this prevented the problem of mass imbalance, it creates generally a more difficult splice to repeatedly make in mass production. This is true because the variation in length between the cut end (12, 14). If the segment (10) varies in length by only a few thousandths of an inch, cord spacing can be affected. Overlapping the splice cords prevents this from being an issue. The present invention permits multi-layered components to be lap spliced with overlapping cords without creating an undue mass imbalance. This is due to the fact that the ply (20) as it is being cut is allowed to lift such that the elastomeric material above the cutting element (120) is removed forming a flat cut surface (8) for approximately a length of three or more cords (22) as shown in the illustrated embodiment of FIG. 5C. This permits lap splices (15) to be done effectively and efficiently. What is unusual is that this can be accomplished without additional cutting or additional steps. All cutting is done in one simple operation of passing the ultrasonic blade (120) through the multi-layered component or strip (1).

With reference to the supporting means (110), it is shown that the supporting means is angled as previously discussed, the first outer surface (111) is inclined at a first angle θ1 and the second outer surface (112) is inclined at a second angle θ2. Internal of the supporting means (110) preferably are a plurality of holes (116) that intersect the surfaces (111, 112) and are connected to vacuum system. This vacuum system helps keep the strip (1) secure to the support during the cutting procedure and helps assist in this matter. To further assist and holding the elastomeric strip (1) in place during the cutting procedure a retraining means (130) is provided just ahead of the cutting element (120). This restraining means (130) as illustrated, is a wheel (132) that rotates and is moveable along the same path as the cutting means (120). This wheel (132) traverses directly in front of the cutting path (3) but is at a sufficient distance to enable the strip (1) to lift and pass over the cutting blade (120) as the blade is traversing.

Figures 6A, 6B:
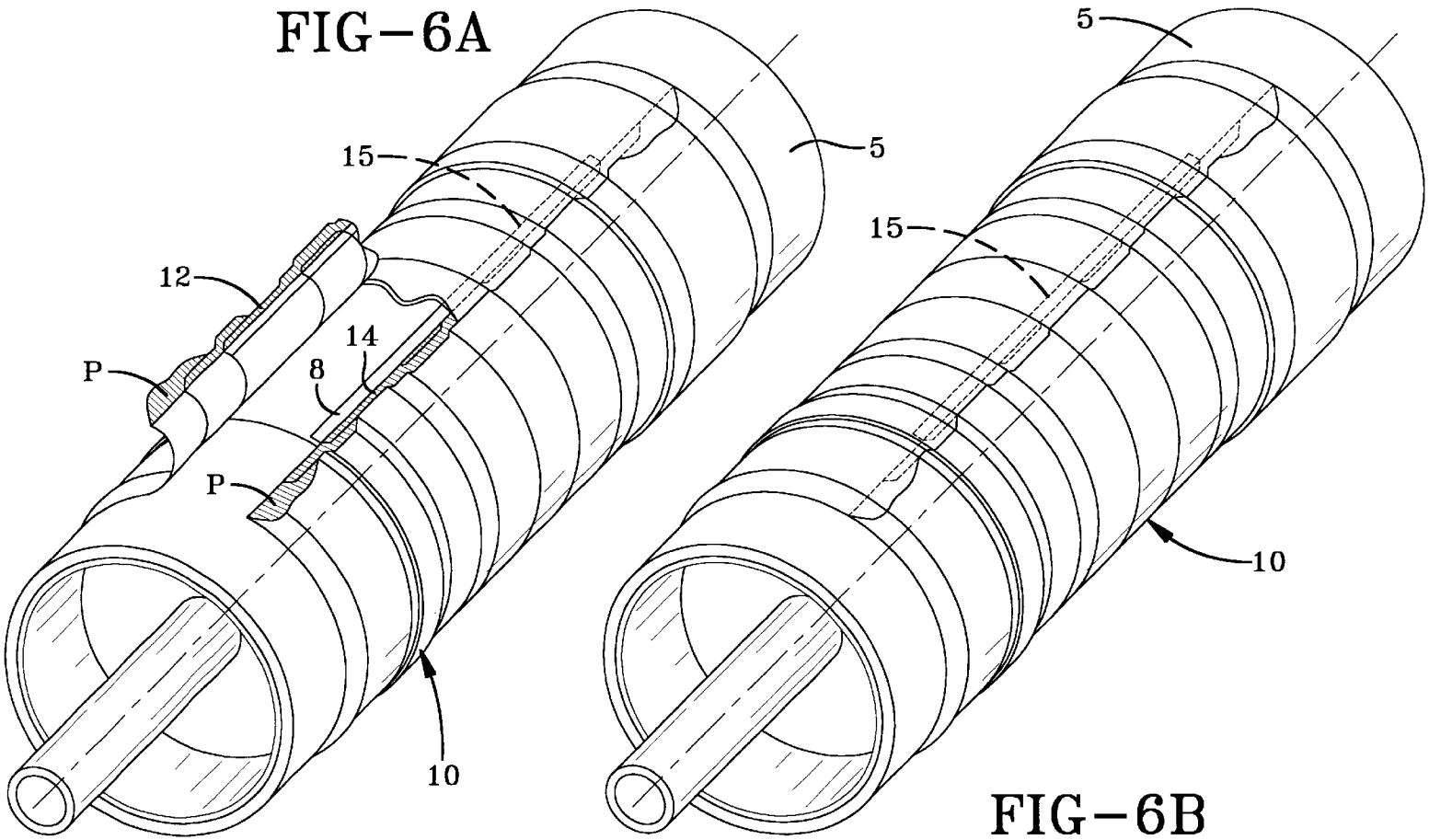
FIG. 6A is a perspective view show in the segment being formed cylindrically about a tire-building drum.
FIG. 6B is a perspective view of the cylindrically formed segment of FIG. 6A.

With reference to FIGS. 6A and 6B, the joining of the splice ends (12, 14) occurs when the cut-to-length segment (10) is cylindrically formed around a tire building drum (5) as illustrated. As shown, the tire builder ideally brings the cut surfaces (12, 14) together in a lapping splice relationship along a common plane P. This precisely sets the circumferential length of the segment. The surfaces (6, 8) are then pressed together in a technique commonly referred to as stitching.

Figure 7:
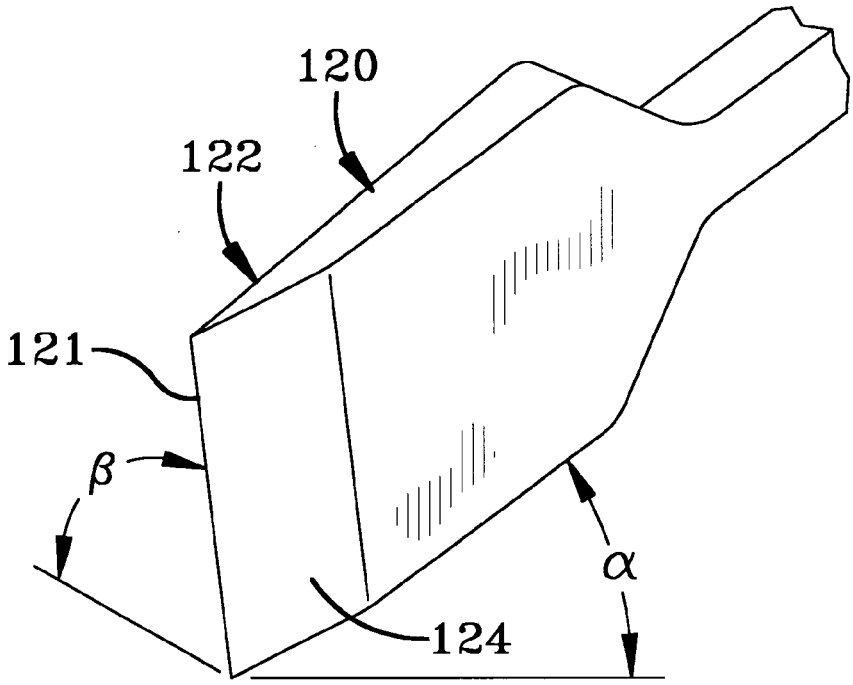
FIG. 7 is a perspective view of a first cutting element for forming the low skive angle surface, the preferred first cutting element being an ultrasonic knife.

The apparatus (100) has a means (120) for forming a low angle skive surfaces across the width of the strip. The means preferably is a cutting element (120). In the most preferred apparatus the cutting element (120) is an ultrasonic knife. As shown in FIG. 7, the knife (120) preferably has a somewhat wedge like shape with a cutting edge (121) that is oriented at a fixed angle alpha relative to the strip cut path (3) and is also canted at an angle β such that the cutting edge (121) is inclined slightly at an acute angle relative to the width of the ply. This dual angle setting of the cutting element (120) achieves a superior more uniformed cut because the knife's cutting edge (124) is really the tip of a chisel type-cutting tool. Unlike a conventional ultrasonic low amplitude high frequency knife that cuts along a side of the blade, the chisel type blade has no node along the cutting edge (121) because the cutting edge (121) is really the tip of the blade tilted and canted slightly. This means that the excitation frequency is traveling in the same distance all along the cutting edge (121). This fact enables the rubber to be cut more uniformly than conventionally by standard ultrasonic blade type cutters.

A second feature, the preferred apparatus (100) is a means for moving the means (120) for forming and the means (130) for restraining. The means (140) for moving preferably has a motor driven mechanism that slidedly traverses the means (120) for forming and the means (130) for restraining across the width of the strip (1). The means (120) ideally can be moved angularly relative to the strip length to accommodate cutting along any bias angle.

Figure 9:
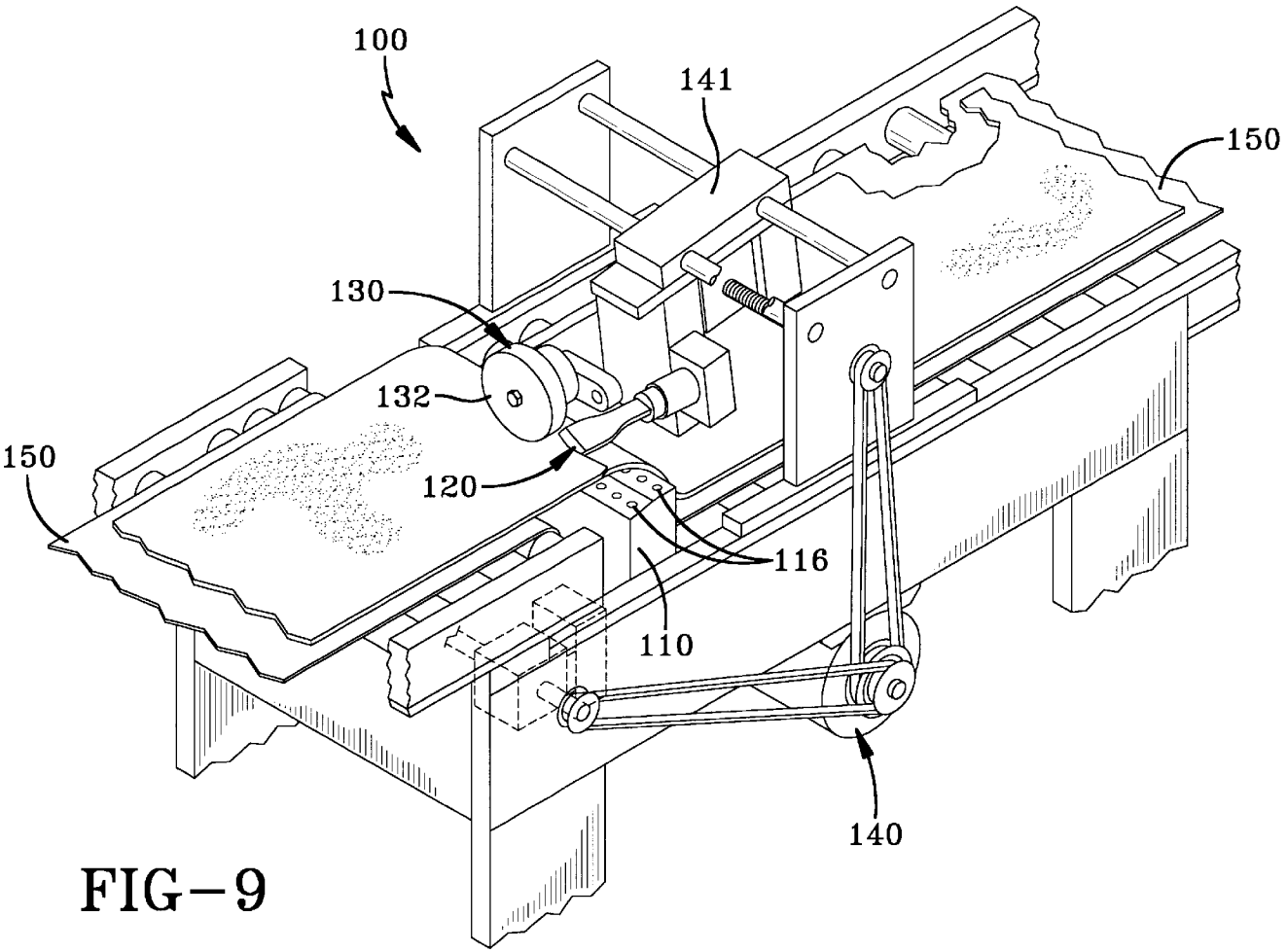
FIG. 9 is a perspective view of the preferred apparatus (100) or forming the segment.

The means for moving (140) may also include a means 141 for orienting the cutting element (120) at a range of angles to achieve the optimum skive surface area. As shown in FIG. 9, the prefer apparatus (100) may include a conveyor means (150) to advance the strip (1) along the direction of the strip (1) length preferably the conveyor means (150) would be capable of advancing the strip (1) to a predetermined distance to enable the strip (1) to be cut to form a segment (10) having a fixed length L between the cut surfaces (12, 14) at a location S1 and S2 as previously shown.

Figure 10A:
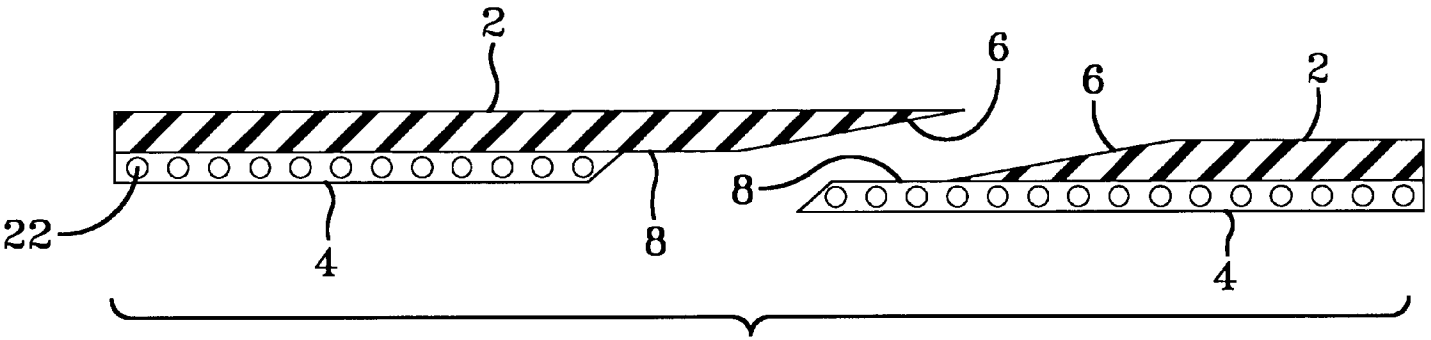
FIGS. 10A and 10B show a cross-section of the cut ends, 10B being the joined lap splice.
Figure 10B:
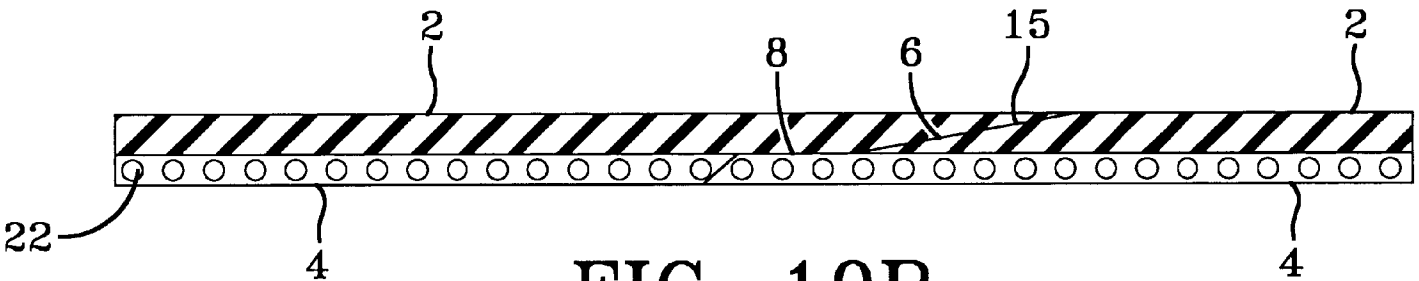

Once cut, the segment (10), when spliced has the cut ends (12, 14) joined and the strip (1) cylindrically forms a tire as previously discussed. The segment (10) as shown in FIGS. 8A, 8B and 8C can be thick, thin, flat, or irregularly contoured, a single cord reinforced component (20) or a multi-component as discussed. The angular orientation of the surfaces (6, 8) relative to a normal plane NB can be selected for optimum lap joint splicing for the particular strip as shown in FIGS. 10A and 10B.

While the strip may include some cured or partially cured components, it is preferred that portions of this strip (1) be uncured or at least partially uncured. This permits the spliced surfaces (6, 8) to exhibit the tacky, self-sticking properties to facilitate joint adhesion at the lap splice (15). While certain representative embodiments and details have been shown for the purpose of illustrating the invention will be appreciated there is still in the art various changes and modifications may be made therein without departing from the spirit or scope of the invention.

What is claimed is:

1. An apparatus for cutting segments from a strip of multi-layered elastomeric material containing reinforcing cords without cutting said reinforcing cords, the cords being substantially parallel and more or less oriented in a same direction of a cut path, the apparatus comprising:

(a) a cutting element for cutting the strip to form cut ends, the cutting element having a cutting edge positioned to cut along a line tangent to said one or more reinforcing cords; said cutting edge being inclined at a skive angle α and at an angle β relative to the width of the strip (b) an anvil having a first surface oriented at an angle θ1 less than the skive angle α and a second surface oriented at an angle θ2 greater than or equal to the skive angle α;

(c) and wherein the cutting edge of the cutting element is set at a gap distance (d) above the anvil, where the anvil is oriented at the angle θ2, wherein (d) is slightly less than or equal to the thickness of the reinforcing cords.

2. The apparatus of claim 1 wherein the skive angle (is about 10° or less adjacent the one or more cords.

3. The apparatus of claim 2 wherein the angle θ1, is about 2° less than α.

4. The apparatus of claim 3 wherein the angle θ2 is about 2° more than α.

5. The apparatus of claim 3 wherein α is about 8°.

6. The apparatus of claim 1 wherein the cutting element is an ultrasonic knife.

7. The apparatus of claim 6 wherein the cutting element has a flat or planar surface adjacent the supporting means.

8. The apparatus of claim 7 wherein the cutting element has a wedge shape increasing in thickness from the cutting edge.

9. The apparatus of claim 1 wherein the means for supporting the strip include a vacuum means formed by a plurality of holes intersecting surfaces of the support means and connected to a vacuum system for holding the strip to the means for supporting.

10. The apparatus of claim 1 wherein the cutting element has the cutting edge set at a gap (d), (d) being measured at a location on the support means wherein the first surface meets the second surface.

* * * * *